US005717408A

United States Patent [19]

Sullivan et al.

[11] Patent Number: 5,717,408

[45] Date of Patent: Feb. 10, 1998

[54] RETRACTABLE ANTENNA FOR A CELLULAR TELEPHONE

[75] Inventors: Jonathan Lee Sullivan, Lincoln; Glen A. Wilcox, Ceresco; Kenneth D. Simmons, Lincoln, all of Nebr.

[73] Assignee: Centurion International, Inc., Lincoln, Nebr.

[21] Appl. No.: 574,404

[22] Filed: Dec. 18, 1995

[51] Int. Cl.[6] ..... H01Q 1/24

[52] U.S. Cl. ..... 343/702; 343/729; 343/895; 343/900

[58] Field of Search ..... 343/702, 749, 343/900, 901, 729, 895; H01Q 1/24

[56] References Cited

U.S. PATENT DOCUMENTS

| | | | |
|---|---|---|---|
| 4,205,319 | 5/1980 | Gasparaitis et al. | 343/792 |
| 4,760,401 | 7/1988 | Imazeki | 343/702 |
| 4,849,767 | 7/1989 | Naitou | 343/745 |
| 4,867,698 | 9/1989 | Griffiths | 439/317 |
| 5,079,558 | 1/1992 | Koike | 343/702 |
| 5,177,492 | 1/1993 | Tomura et al. | 343/702 |
| 5,204,687 | 4/1993 | Elliott et al. | 343/702 |
| 5,214,434 | 5/1993 | Hsu | 343/702 |
| 5,218,370 | 6/1993 | Blaese | 343/702 |
| 5,300,940 | 4/1994 | Simmons | 343/749 |
| 5,317,325 | 5/1994 | Bottomley | 343/702 |
| 5,353,036 | 10/1994 | Baldry | 343/702 |
| 5,455,595 | 10/1995 | Yokoyama et al. | 343/702 |
| 5,479,178 | 12/1995 | Ha | 343/702 |

FOREIGN PATENT DOCUMENTS 3245603 11/1991 Japan .

OTHER PUBLICATIONS

"Lightweight Trap Antennas—Some Thoughts" Jun. 1983, QST, Jun. 1993, p. 15.

*Primary Examiner*—Michael C. Wimer

*Attorney, Agent, or Firm*—Zarley, McKee, Thomte, Voorhees & Sease; Dennis L. Thomte

[57] ABSTRACT

A retractable antenna for use with a cellular telephone wherein the retractable antenna is removably mounted on the upper end of the telephone. The retractable antenna includes an antenna housing which extends upwardly from the upper end of the telephone and which has a matching circuit provided therein. A helical radiator is positioned in the antenna housing and has its lower end operatively connected to the matching circuit. An elongated radiator is selectively vertically movably positioned in the antenna housing and the telephone and is movable between extended and retracted positions with respect to the antenna housing and the telephone housing. The lower end of the elongated radiator is electrically connected to the upper end of the helical radiator when the elongated radiator is in its extended position. The elongated radiator is electrically disconnected from the helical radiator when the elongated radiator is in its retracted position. The matching circuit in the telephone housing is operatively electrically connected to the telephone circuitry so that the antenna serves as a ¼ wave antenna when the elongated radiator is in its retracted position and so that the antenna serves as a ½ wave antenna when the elongated radiator is in its extended position.

18 Claims, 3 Drawing Sheets

RETRACTABLE ANTENNA FOR A CELLULAR TELEPHONE

BACKGROUND OF THE INVENTION

1. Field of the Invention

This invention relates to an antenna for a cellular telephone and more particularly to an antenna which has two electrical functions; namely, first as a fully extended ½ wave antenna and second as a ¼ wave antenna when the antenna is retracted into the telephone. More particularly, this invention relates to an antenna which utilizes a common feed point matched at 50 ohms.

2. Description of the Related Art

Cellular telephones have become extremely popular in recent years. It has been found that the cellular telephones are more compact and portable when they are provided with retractable antennas. However, the retractable characteristics of the antenna interfere with the performance thereof, especially when the antenna is retracted.

One type of retractable antenna is that manufactured by Galtronics which has been marketed as a "retractable" two-in-one antenna. The Galtronics antenna consists of a full ¼ wave element plus a ¼ wave helical element in one antenna. It is believed that there is no electrical connection between the two elements which therefore limits the antenna to a ¼ wave antenna.

Further, in some types of antennas, a pair of ¼ wave antenna elements are provided in a single antenna wherein when the antenna is in its retracted position the antenna serves as a ¼ wave antenna and when the antenna is in its extended position the antenna functions as a ½ wave antenna. However, in those prior art antennas just described, a matching circuit is normally provided due to the different impedance at the feed points for the two antenna elements. Those matching circuits are normally positioned in the telephone housing and such positioning in the housing consumes space which necessarily affects the compactness of the unit. Further, when the matching circuit is located within the telephone housing, it is necessary that the telephone itself be repaired should the matching circuit fail.

Further, in other types of retractable antennas for use with cellular telephones, most, if not all, electrical contacts for the antenna elements are located in the telephone housing and should those contacts fail, the telephone itself must be repaired.

SUMMARY OF THE INVENTION

A retractable antenna is disclosed for use with a cellular telephone which has a metal receptacle at the upper end which is operatively electrically connected to the ground of the circuitry within the telephone. The cellular telephone also has a first metal contact therein which is also electrically connected to the telephone circuitry. A first connector, having a vertically disposed bore extending therethrough, is removably received in the metal receptacle and has an upper end which is positioned at the upper end of the housing. A disc-shaped circuit board is positioned on the upper end portion of the first connector and includes a matching circuit provided thereon.

An antenna housing extends upwardly from the first connector and has a helical radiator positioned therein which has upper and lower ends. The lower end of the helical radiator is electrically connected to the matching circuit. A metal sleeve is positioned in the bore of the first connector and is operatively electrically connected to the matching circuit. The metal sleeve has a contact at its upper end which is positioned above the circuit board and a lower end which is positioned below the lower end of the first connector. The lower end of the metal sleeve is electrically connected to the first contact in the telephone housing.

An elongated whip assembly is selectively vertically movably positioned in the antenna housing and is movable between extended and retracted positions. The whip assembly includes an upper whip portion which is comprised of a non-electrically conductive material and which has a second metal contact positioned thereon, on the exterior surface, between the upper and lower ends thereof. The whip assembly also includes an elongated metal rod or radiator which extends downwardly from the lower end of the upper whip portion with the elongated metal radiator being enclosed by a non-electrically conductive material. A third metal contact is secured to the elongated metal radiator at the lower end thereof. The whip assembly also includes an elongated lower whip portion which extends downwardly from the lower end of the elongated metal radiator. The lower whip portion is comprised of a non-electrically conductive material. The third metal contact on the elongated metal radiator is in operative electrical engagement with the upper end of the helical radiator when the whip assembly is in its extended position so that the antenna functions as a ½ wave antenna. The second metal contact on the upper whip portion is in operative electrical contact with the lower end of the helical radiator and the metal sleeve when the whip assembly is in its retracted position so that the antenna functions as a ¼ wave antenna.

The matching circuit is activated when the antenna is in the extended position, thus improving the performance of the end-fed ½ wave antenna. The matching circuit network is bypassed when the antenna is in the retracted ¼ wave position. The antenna of this invention utilizes a single feed point with a constant feed impedance of 50 ohms.

A principal object of the invention is to provide a retractable antenna for a cellular telephone.

A further object of the invention is to provide a retractable antenna which functions as a ¼ wave antenna when the antenna is in its retracted position and which functions as a ½ wave antenna when it is in a fully extended position.

A further object of the invention is to a provide a retractable antenna of the type described above which includes a common feed point matched at 50 ohms.

Yet another object of the invention is to provide a retractable antenna of the type described above wherein an internal L-C matching circuit is activated when the antenna is in the extended position, thus improving the performance of the end-fed ½ wave antenna and wherein the matching circuit is bypassed when the antenna is in the retracted ¼ wave position.

Yet another object of the invention is to provide a retractable antenna of the type described above wherein a matching circuit is provided which is mounted in the antenna itself so that the matching circuit may be serviced by simply removing the antenna from the telephone.

Still another object of the invention is to provide a retractable antenna of the type described above which utilizes contacts in the antenna itself so that contacts are easy to replace by simply replacing the antenna.

Still another object of the invention is to provide a retractable antenna of the type described above wherein the antenna may be removed so that test equipment may be inserted into the metal receptacle in the upper end of the telephone housing.

Still another object of the invention is to provide a retractable antenna of the type described above which utilizes a contact 50 ohm impedance.

Yet another object of the invention is to provide a retractable antenna of the type described above which can accommodate various 50 ohm antennas, thereby permitting different antennas to be easily mounted on the telephone.

These and other objects of the present invention will be apparent to those skilled in the art.

DESCRIPTION OF THE PREFERRED EMBODIMENT

Figure 1:
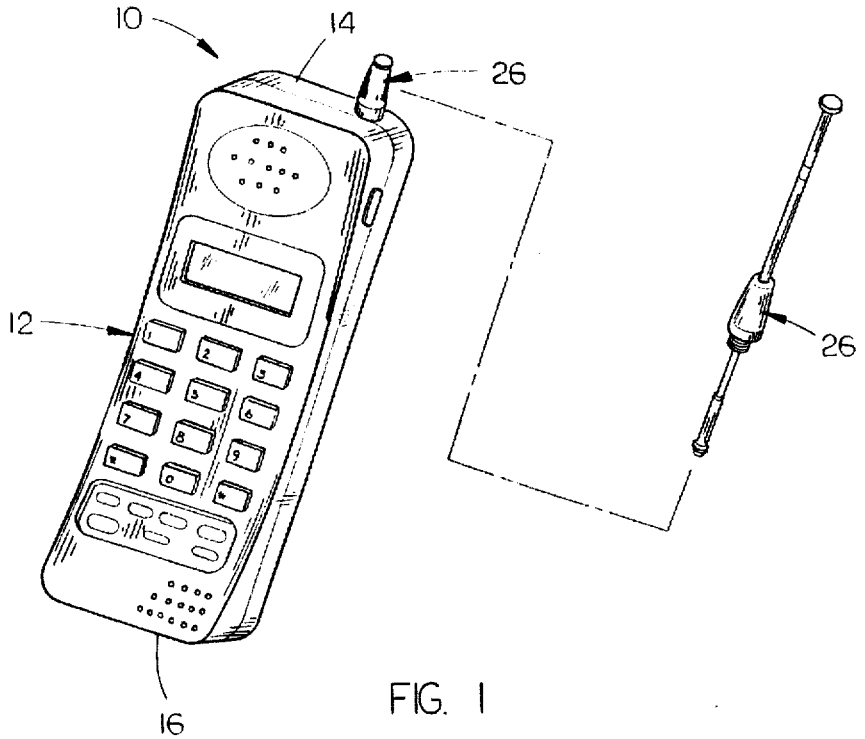
FIG. 1 is a perspective view of a cellular telephone having the antenna of this invention mounted therein and which also illustrates the antenna removed from the telephone.
Figure 2:
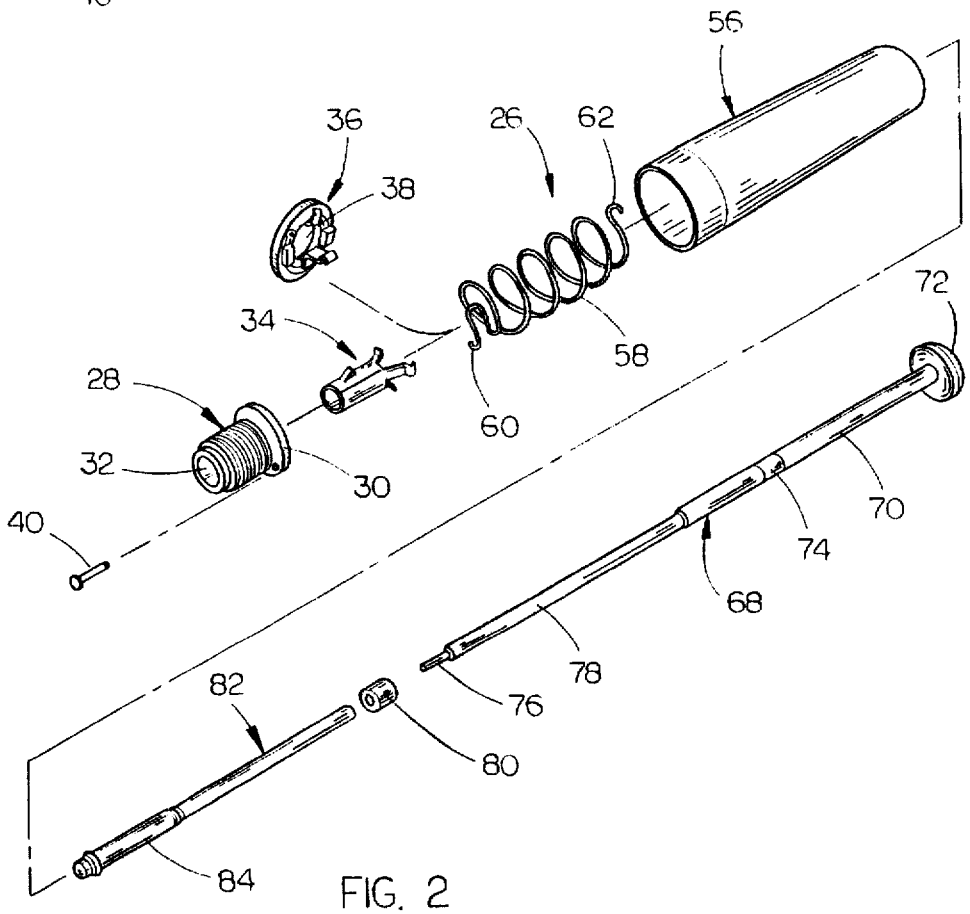
FIG. 2 is an exploded perspective view of the antenna of this invention.

The numeral 10 refers to a conventional cellular telephone having a housing 12 including an upper end 14 and a lower end 16. Housing 12 is provided with a metal receptacle 18 at the upper end thereof, as seen in the drawings. Receptacle 18 is electrically connected to the internal circuitry 20 of the telephone 10 in conventional fashion and has a threaded opening 22 formed therein which receives the connector of the antenna as will be described in more detail hereinafter. A switch, preferably a spring switch, 24 is positioned in the housing 12 and is electrically connected to the internal circuit 20 in conventional fashion. Switch 24 is electrically connected to the internal circuitry transferring the signal between the internal circuit of the telephone and the antenna and vice versa. Preferably, the connection of the metal receptacle 18 to the internal circuit 20 functions as a grounding circuit.

The antenna of this invention is referred to generally by the reference numeral 26 and may be selectively moved between the extended and retracted positions as will be described in more detail hereinafter. Antenna 26 includes a connector 28 which is adapted to be threadably inserted into the metal receptacle 18. Connector 28 is not electrically conductive and is preferably comprised of a plastic polycarbonate material. Connector 28 includes an upper end portion 30 which is positioned above the receptacle 18 when connector or fitting 28 is threadably inserted into the receptacle 18. Connector 28 has a vertically disposed bore 32 formed therein adapted to receive the metal sleeve 34. A disc-shaped circuit board 36 is positioned on the upper end 30 of connector 28 and has a bore or opening 38 formed therein which receives the sleeve 34. Circuit board 36 includes a metal ground pin 40 which extends downwardly from the upper portion of the circuit board 36 to below the upper end portion 30 of connector 28 so that ground pin 40 is in electrical engagement with the metal receptacle 18 when the antenna is installed on the telephone housing. Ground pin 40 is preferably conventionally electrically connected to a 0.6 pf capacitor 44 by trace 46. Trace 48 operatively electrically connects capacitor 44 to a 22 nh inductor 50. Inductor 50 is electrically connected to a trace 52 extending therefrom which is in operative electrical engagement with the metal sleeve 34 as will be described in greater detail hereinafter. Traces 46, 48 and 52 are preferably comprised of a conventional copper material.

Figure 7:
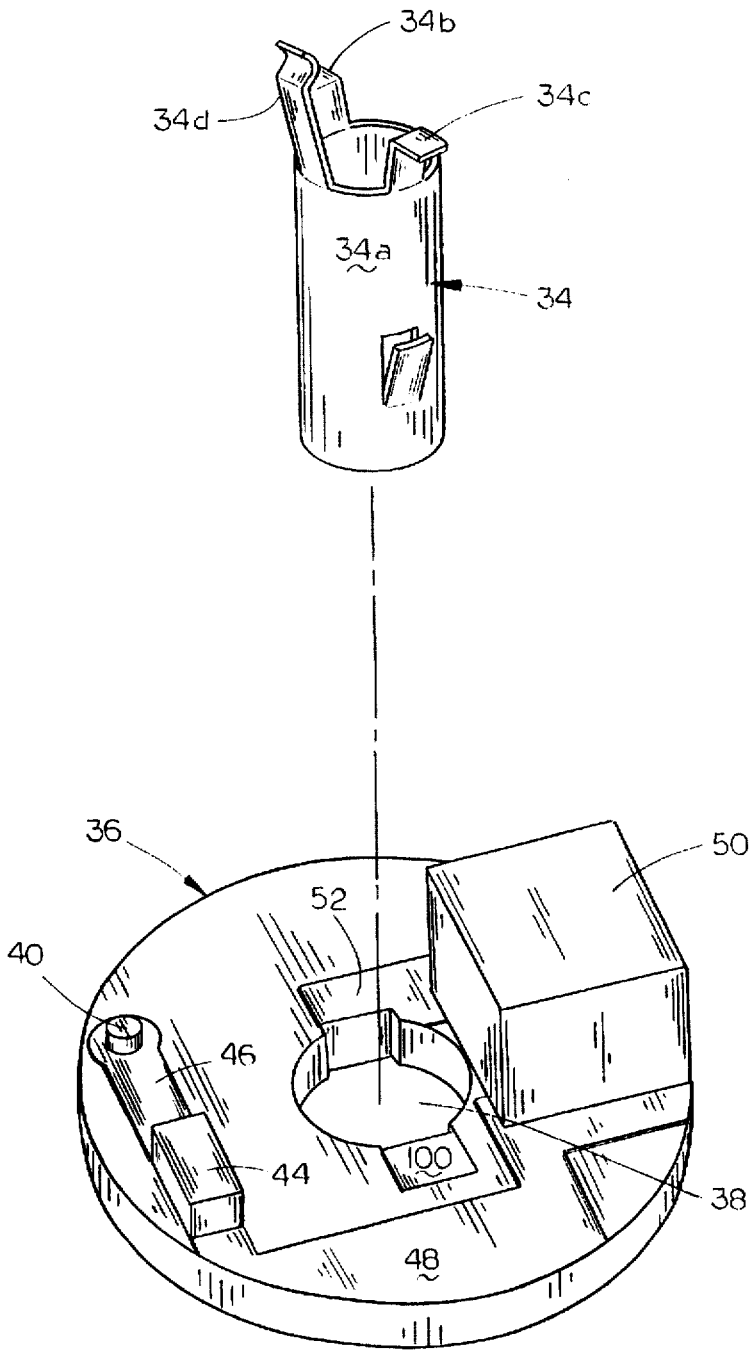
FIG. 7 is an exploded perspective view of the circuit board and sleeve of this invention.

As best seen in FIG. 7, sleeve 34 includes a tubular portion **34*a*, contact 34*b*, support 34*c* and spring contact 34*d* extending upwardly from tubular portion 34*a*. Tubular portion 34*a* is in electrical contact with contact 24 in telephone 10. Contact 34*b* is in electrical contact with trace 52 while support 34*c* rests on a non-electrical conductive area on circuit board 36 which is referred to generally by the reference numeral 100**.

Figure 3:
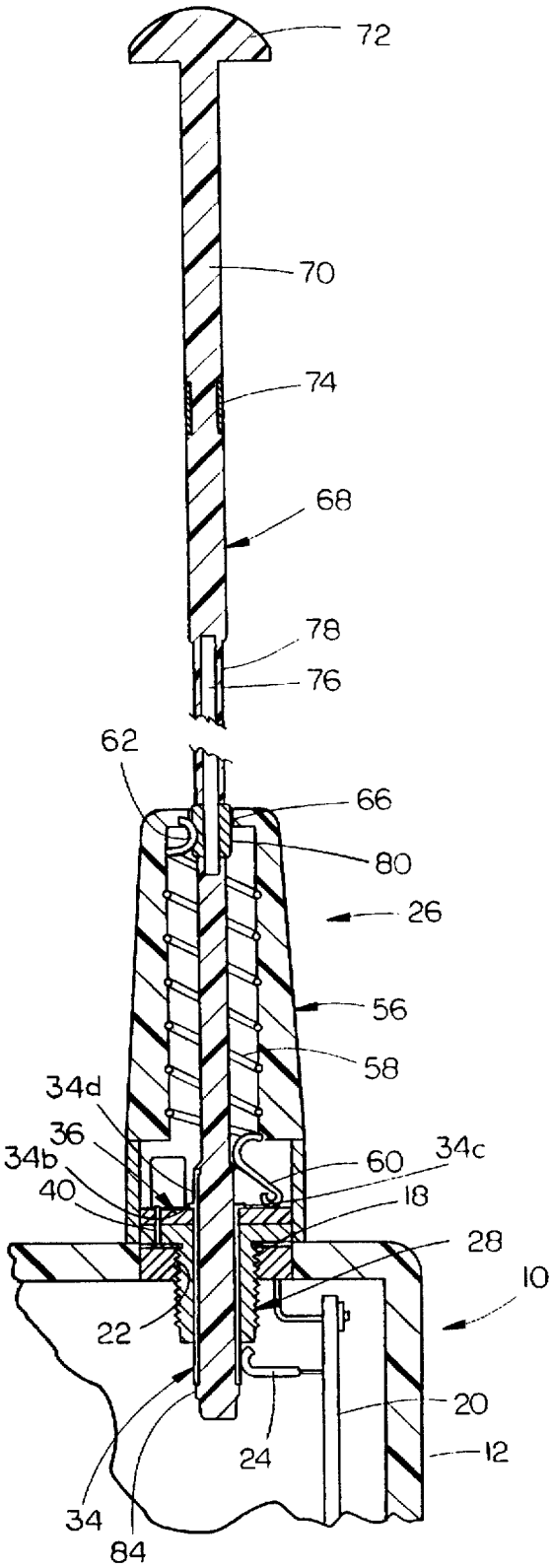
FIG. 3 is a partial vertical sectional view of the antenna of this invention mounted on a cellular telephone with the antenna in an extended position.

The numeral 56 refers to a plastic, preferably polyurethane, housing which has its lower end embracing the upper end portion of the connector 28, as seen in the drawings. The numeral 58 refers to a helical radiator provided in housing 56 and which has a bottom spring contact 60 in operative engagement with the circuit of the circuit board 36. Radiator 58 also includes a top spring contact 62 which protrudes inwardly from the inner wall surface 64 of the housing 56, as seen in FIG. 3. Housing 56 is also provided with an opening 66 formed in its upper end which slidably receives the movable portion of the antenna as will be described in more detail hereinafter.

Generally speaking, the numeral 68 refers to a whip assembly as will now be described. Whip assembly 68 includes an upper whip portion 70 having an enlarged portion 72 at the upper end thereof. Upper whip portion 70 is comprised of a plastic material, preferably acetal. A metal slide contact 74 is positioned on the exterior surface of the upper whip portion 70 above the lower end thereof, as seen in FIG. 3.

An elongated metal rod or radiator 76, preferably comprised of a nickel-titanium material, extends downwardly from the lower end of upper whip portion 70 and is enclosed or embedded in a non-electrically conductive plastic material such as acetal or the like, and is referred to generally by the reference numeral 78. A metal, preferably brass, contact 80 is electrically connected to the lower end of the elongated radiator 76. Whip assembly 68 also includes a lower whip portion 82 which extends downwardly from the lower end of the elongated radiator 76. Lower whip portion 82 is provided with an enlarged diameter portion 84 which is in frictional engagement with the interior surface of sleeve 34 when the whip assembly 68 is in its extended position, as illustrated in FIG. 3.

When the whip assembly 68 is in the extended position, contact 80 is received within the opening 66 of the housing 56 and is in electrical contact with the top spring contact 62. The top radiator 76 and the helical radiator 58 are now energized and create an approximate ½ wave antenna. More specifically, when the antenna is in its extended position, power passes from circuit 20, through contact 24, and into sleeve 34. The electrical energy is passed from contact 34b into trace 52, through inductor 50, through trace 48, through capacitor 44, through trace 46, through pin 40, through receptacle 18 and into circuitry 20. Lower spring contact 60 of radiator 58 engages trace 48. Thus, in the extended position, the matching circuit is activated, thereby improving the performance of the end-fed ½ wave antenna.

When the whip assembly 68 is in the retracted position, upper end portion 72 rests upon the upper end of housing 56.

Figure 4:
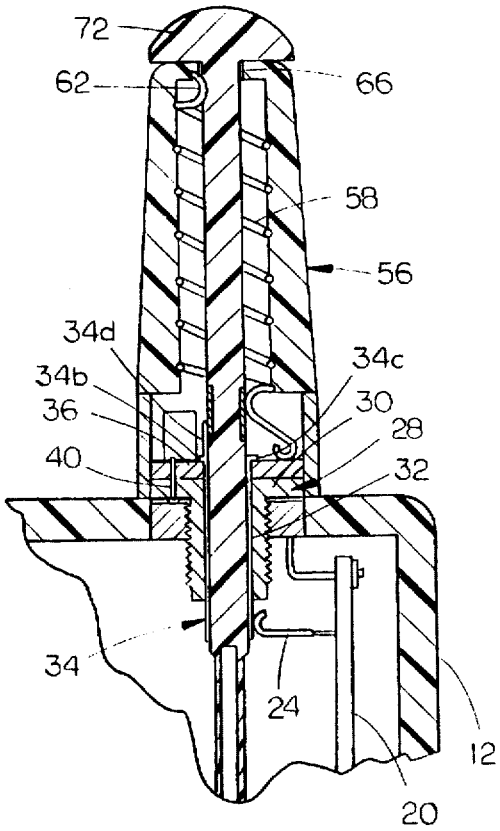
FIG. 4 is a view similar to FIG. 3 except that the antenna is in its retracted position.
Figure 5:
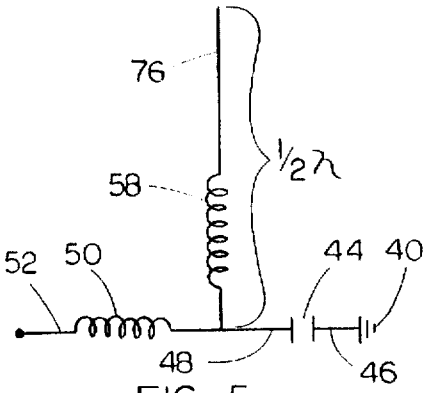
FIG. 5 is a schematic illustrating the antenna circuit in the extended ½ wave mode.
Figure 6:
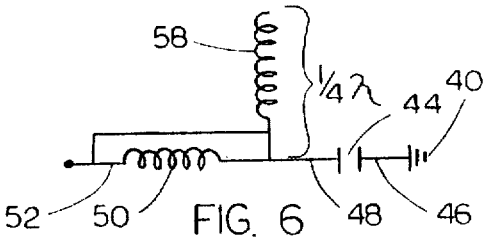
FIG. 6 is a schematic illustrating the antenna circuit in the retracted ¼ wave mode.

When the whip assembly 68 is in the retracted position, as illustrated in FIG. 4, slide contact 74 is in engagement with the spring contact 34*d* on the sleeve 34 and is in electrical connection with the bottom spring contact 60. More specifically, when the antenna is in its retracted position, the matching circuit is bypassed due to the engagement of the slide contact 74 with the spring contact 34*d*. It can therefore be seen that the antenna uses a common feed point matched at 50 ohms. In normal operation, the operator of the telephone will leave the antenna in its retracted (¼ wave) position. The antenna will be extended to its ½ wave position when the user is making a call or when in a marginal coverage area.

Thus it can be seen that any type of 50 ohm antenna may be inserted into the metal receptacle 18. The fact that the matching and other contacts are located with the antenna itself makes the repair or replacement of the same very easy since it is not necessary to repair or replace any of the components within the telephone housing itself. Further, the metal receptacle 18 will accommodate test equipment, thereby making the repair of the telephone a relatively easy procedure.

Thus it can be seen that the antenna of this invention accomplishes at least all of its stated objectives.

We claim:

1. A retractable antenna for a cellular telephone including a housing having upper and lower ends, circuitry within said housing, a metal receptacle at the upper end of said housing which is operatively electrically grounded to said circuitry in said housing and a first contact in said housing which is electrically connected to said circuitry, comprising:

a first connector selectively removably secured to said metal receptacle and having upper and lower ends;

said first connector having a vertically disposed bore extending therethrough and being comprised of a material which is non-electrically conductive;

said first connector having a lower end portion which is selectively removably received within said metal receptacle and an upper end portion which is positioned at said upper end of said housing;

a circuit board positioned on said upper end portion of said first connector;

said circuit board including a matching circuit;

an antenna housing having upper and lower ends;

said antenna housing extending upwardly from said first connector;

said antenna housing having a helical radiator positioned therein which has upper and lower ends;

said lower end of said helical radiator being operatively electrically connected to said matching circuit;

an elongated metal sleeve positioned in said bore of said first connector and being operatively electrically connected to said matching circuit;

said metal sleeve having an upper end which is positioned above said circuit board and a lower end which is positioned below the lower end of said lower end portion of said first connector;

said lower end of said metal sleeve being electrically connected to said first contact in said telephone housing;

an elongated whip assembly selectively vertically movably positioned in said antenna housing and in said telephone housing and being movable between extended and retracted positions with respect to said antenna housing and said telephone housing;

said whip assembly comprising an elongated upper whip portion having upper and lower ends, said upper whip portion being comprised of a non-electrically conductive material;

said upper whip portion having a second metal contact positioned thereon intermediate its upper and lower ends;

said whip assembly also including an elongated metal radiator, having upper and lower ends, extending downwardly from the lower end of said upper whip portion, said elongated metal radiator, except for its lower end, being enclosed by a non-electrically conductive material;

a third metal contact electrically connected to said elongated metal radiator at the lower end thereof;

said whip assembly also including an elongated lower whip portion, having upper and lower ends, which extends downwardly from the lower end of said elongated metal radiator;

said lower whip portion being comprised of a non-electrically conductive material;

said third metal contact on said elongated metal radiator being in operative electrical engagement with the upper end of said helical radiator when said whip assembly is in its extended position;

said second metal contact on said upper whip portion being in operative electrical contact with said lower end of said helical radiator and said metal sleeve when said whip assembly is in its said retracted position.

2. The retractable antenna of claim 1 wherein the antenna serves as a ½ wave antenna when said whip assembly is in its extended position and wherein the antenna serves as a ¼ wave antenna when said whip assembly is in its retracted position.

3. The retractable antenna of claim 2 wherein said matching circuit is bypassed when said whip assembly is in its retracted position so that said elongated radiator is electrically decoupled from said helical radiator.

4. The retractable antenna of claim 2 wherein said helical radiator and said elongated radiator have common feed points.

5. The retractable antenna of claim 2 wherein said helical radiator and said elongated radiator have common feed points matched at approximately 50 ohms.

6. The retractable antenna of claim 1 wherein said circuit board comprises a disc-shaped member having a central opening formed therein; said disc-shaped member having a top surface; said matching circuit comprising a first trace extending from said central opening and electrically connected to one end of an inductor, a second trace electrically connected to the other end of said inductor, a capacitor electrically connected to said second trace and a third trace electrically connected to said capacitor; a grounding element electrically connected to said third trace and being operatively electrically connected to said metal receptacle in said telephone housing; said metal sleeve being in operative electrical engagement with said first trace.

7. The retractable antenna of claim 6 wherein said sleeve has a spring contact extending from its upper end, said second metal contact in said upper whip portion being in electrical contact with said spring contact on said sleeve and with the lower end of said helical radiator when said antenna is in its retracted position so that said matching circuit is bypassed.

8. The retractable antenna of claim 6 wherein said grounding element comprises a ground pin which is electrically connected to and extends between said third trace and said metal receptacle.

9. A retractable antenna for a cellular telephone including a housing having upper and lower ends and circuitry within said housing, comprising:

an antenna housing selectively removably secured to said telephone housing at the upper end thereof and extending upwardly therefrom;

a circuit board in said antenna housing and having a matching circuit provided thereon;

said antenna housing having a helical radiator positioned therein which has upper and lower ends;

said lower end of said helical radiator being operatively electrically connected to said matching circuit;

an elongated metal sleeve operatively electrically connected to said matching circuit;

said metal sleeve having an upper end which is positioned above said circuit board and a lower end which is positioned within said telephone housing;

said lower end of said metal sleeve being operatively electrically connected to said circuitry in said telephone housing;

an elongated whip assembly selectively vertically movably positioned in said antenna housing and in said telephone housing and being movable between extended and retracted positions with respect to said antenna housing and said telephone housing;

said whip assembly comprising an elongated upper whip portion having upper and lower ends, said upper whip portion being comprised of a non-electrically conductive material;

said upper whip portion having a metal contact positioned thereon intermediate its upper and lower ends;

said whip assembly also including an elongated metal radiator, having upper and lower ends, extending downwardly from the lower end of said upper whip portion, said elongated metal radiator, except for its lower end, being enclosed by a non-electrically conductive material;

a metal contact electrically connected to said elongated metal radiator at the lower end thereof;

said whip assembly also including an elongated lower whip portion, having upper and lower ends, which extends downwardly from the lower end of said elongated metal radiator;

said lower whip portion being comprised of a non-electrically conductive material;

said metal contact on said elongated metal radiator being in operative electrical engagement with the upper end of said helical radiator when said whip assembly is in its extended position;

said metal contact on said upper whip portion being in operative electrical contact with said lower end of said helical radiator and said metal sleeve when said whip assembly is in its said retracted position.

10. The retractable antenna of claim 9 wherein the antenna serves as a ½ wave antenna when said whip assembly is in its extended position and wherein the antenna serves as a ¼ wave antenna when said whip assembly is in its retracted position.

11. The retractable antenna of claim 10 wherein said matching circuit is bypassed when said whip assembly is in its retracted position so that said elongated radiator is electrically decoupled from said helical radiator.

12. The retractable antenna of claim 10 wherein said helical radiator and said elongated radiator have common feed points.

13. The retractable antenna of claim 10 wherein said helical radiator and said elongated radiator have common feed points matched at approximately 50 ohms.

14. A retractable antenna for a cellular telephone including a housing having upper and lower ends and circuitry within said housing, comprising:

an elongated antenna housing, having upper and lower ends, removably positioned on the upper end of said telephone housing;

a disc-shaped matching circuit support positioned in said antenna housing above the lower end thereof; said matching circuit support including a central opening;

a matching circuit provided on said matching circuit support;

said antenna housing having a helical radiator positioned therein which has upper and lower ends;

said helical radiator being positioned above said matching circuit;

said lower end of said helical radiator being operatively electrically connected to said matching circuit;

an elongated radiator, having upper and lower ends, selectively vertically movably positioned in said antenna housing and said telephone housing and being movable between extended and retracted positions with respect to said antenna housing and said telephone housing;

said elongated radiator selectively movably extending through said central opening of said matching circuit support;

the majority of the length of said elongated radiator being positioned above said helical radiator when in its said extended position;

said elongated radiator being electrically connected, adjacent its lower end, to the upper end of said helical radiator when said elongated radiator is in its said extended position;

said elongated radiator being electrically disconnected from said helical radiator when said elongated radiator is in its said retracted position;

said matching circuit being operatively electrically connected to the circuitry within said telephone housing.

15. The retractable antenna of claim 14 wherein the antenna serves as a ½ wave antenna when said elongated radiator is in its extended position and wherein the antenna serves as a ¼ wave antenna when said elongated radiator is in its retracted position.

16. The retractable antenna of claim 14 wherein said matching circuit is bypassed when said elongated radiator is in its retracted position so that said elongated radiator is electrically decoupled from said helical radiator.

17. The retractable antenna of claim 14 wherein said helical radiator and said elongated radiator have common feed points.

18. The retractable antenna of claim 14 wherein said helical radiator and said elongated radiator have common feed points matched at approximately 50 ohms.

* * * * *